US008662321B1

(12) United States Patent
Raper

(10) Patent No.: US 8,662,321 B1
(45) Date of Patent: Mar. 4, 2014

(54) SPORTS EQUIPMENT RACK, SYSTEMS AND METHODS OF STORING OR DISPLAYING SPORTS EQUIPMENT

(75) Inventor: David W. Raper, Holt, MO (US)

(73) Assignee: Julie Raper, Holt, MO (US), part interest ( * ) Notice: Subject to any disclaimer, the term of this patent is extended or adjusted under 35 U.S.C. 154(b) by 511 days.

(21) Appl. No.: 12/830,026

(22) Filed: Jul. 2, 2010

Related U.S. Application Data

(60) Provisional application No. 61/222,550, filed on Jul. 2, 2009.

(51) Int. Cl.
*A47F 7/00* (2006.01)

(52) U.S. Cl.
USPC ..... 211/70.5; 211/85.7

(58) Field of Classification Search
USPC ..... 211/87.01, 70.5, 89.01, 95, 96, 99, 211/105.1, 70.6, 60.1, 85.7, 124, 175; 248/229.12, 229.14, 228.3, 200.1; 224/323, 324; 269/43, 291, 71, 289 R
See application file for complete search history.

(56) References Cited

U.S. PATENT DOCUMENTS

| | | | | | |
|---|---|---|---|---|---|
| 2,042,086 | A | | 5/1936 | Aubert | |
| 2,480,353 | A | * | 8/1949 | Bjork | 224/323 |
| 2,707,052 | A | * | 4/1955 | Brown | 211/65 |
| 2,956,813 | A | * | 10/1960 | Madden | 280/815 |
| 3,836,058 | A | * | 9/1974 | Penniman et al. | 224/315 |
| 3,897,895 | A | * | 8/1975 | Read | 224/323 |
| 4,077,554 | A | * | 3/1978 | Goode | 224/559 |
| 4,214,687 | A | * | 7/1980 | Covell | 224/323 |
| 4,341,375 | A | * | 7/1982 | Romanin | 269/43 |
| 4,382,588 | A | * | 5/1983 | Vovk et al. | 269/43 |
| 4,705,177 | A | * | 11/1987 | Oren | 211/70.5 |
| 4,763,797 | A | * | 8/1988 | Egan | 211/70.5 |
| 4,798,298 | A | | 1/1989 | Ursetta | |
| 5,226,570 | A | * | 7/1993 | Pedrini | 224/329 |
| 5,417,335 | A | | 5/1995 | White | |
| 5,601,196 | A | * | 2/1997 | Heer et al. | 211/65 |
| 5,642,818 | A | * | 7/1997 | Brent et al. | 211/70.5 |
| 5,826,908 | A | | 10/1998 | McBride | |
| 6,233,877 | B1 | | 5/2001 | Monroe | |
| 6,446,850 | B2 | * | 9/2002 | Ming-Shun | 224/324 |
| 6,494,642 | B1 | * | 12/2002 | Daly | 405/36 |
| 6,564,949 | B1 | * | 5/2003 | Saathoff | 211/70.6 |
| 6,715,653 | B2 | * | 4/2004 | DeCosta | 224/324 |
| 7,374,051 | B2 | | 5/2008 | Garceau | |
| 2007/0125731 | A1 | * | 6/2007 | Waterman | 211/85.7 |
| 2007/0193966 | A1 | * | 8/2007 | Dettorre | 211/70.5 |
| 2008/0000853 | A1 | * | 1/2008 | Huang | 211/70.6 |

* cited by examiner

*Primary Examiner* — Jonathan Liu
*Assistant Examiner* — Patrick Hawn
(74) *Attorney, Agent, or Firm* — Kutak Rock LLP; Bryan P. Stanley

(57) ABSTRACT

An equipment rack is provided. In one embodiment the rack assembly includes a pair of gripping members that compress about opposing edges along the width of a side of the sports equipment being held within the rack assembly. In several preferred embodiments, the gripping members (or "talons") are adjustable toward each other and/or apart from one another to aid in gripping various sizes and shapes of sports equipment. In a preferred embodiment, the rack is mountable to a wall or other surface via a mounting body associated with the pair of gripping members. In another embodiment, the pair of gripping members are adjustable toward each other and/or apart from each other via an adjustment rod assembly.

21 Claims, 3 Drawing Sheets

SPORTS EQUIPMENT RACK, SYSTEMS AND METHODS OF STORING OR DISPLAYING SPORTS EQUIPMENT

CROSS-REFERENCE TO RELATED APPLICATIONS

This application claims priority pursuant to 35 U.S.C. 119(e) to co-pending U.S. Provisional Patent Application Ser. No. 61/222,550, filed Jul. 2, 2009, the entire disclosure of which is incorporated herein by reference.

FIELD OF THE INVENTION

The present invention relates to sports equipment. More particularly, the present invention relates to racks for storing and displaying sports equipment such as snowboards, skis and the like.

BACKGROUND OF THE INVENTION

Various storage and display racks have been designed to hold sports equipment such as snowboards and skis. Such devices typically require the use of tools to make any adjustments to accommodate equipment of varying sizes. This often entails drilling new holes and/or re-nailing the device to a wall on which it is mounted. Moreover, even when using tools to make such adjustments, each side of the device must be adjusted separately to ensure proper balance of the equipment being held. In addition, conventional devices typically do not include a way to lock the equipment within the device. Therefore, it would be beneficial to provide a rack for sports equipment, and methods of storing or displaying sports equipment that overcomes these and other deficiencies of racks of the prior art.

SUMMARY OF THE INVENTION

An object of the instant invention is to provide improvements to prior art sports equipment racks and methods of storing or displaying sports equipment. Another object of the invention is to provide for the storage and display of equipment such as snowboards, skateboards, skis and the like on a wall or other location, in a safe, secure and aesthetic manner so as to be able to fully view the graphics on the equipment. Still another object of the instant invention is to provide for storage and/or display of sports equipment in a manner that allows boots and bindings to remain attached to the equipment for storage, if such is desired by the user. Another object of the instant invention is to provide for storage and/or display of sports equipment such as skis and snowboards that have a changing width across at least one side of the equipment. Yet another object of the instant invention is to provide for storage and/or display of sports equipment such as skis and snowboards that have a changing width across at least one side of the equipment in which the changing width is utilized in combination with gravity to hold the equipment in position. Another object of the instant invention is to provide for storage and/or display of sports equipment such as skis and snowboards, in which multiple sizes, shapes and/or types of equipment may be stored or displayed in a single storage location. Still another object of the instant invention is to provide for storage and/or display of sports equipment in which the equipment easily may be secured via a lock.

The above described objects, and other objects which will be evident to those skilled in the art, are accomplished through the use of a rack assembly that includes a pair of gripping members that compress about opposing edges along the width of a side of the sports equipment being held within the rack assembly. In several preferred embodiments, the gripping members (or "talons") are adjustable toward each other and/or apart from one another to aid in gripping various sizes and shapes of sports equipment. The devices of embodiments of the instant invention are mountable to a wall or other surface via a mounting body associated with the pair of gripping members, and in some embodiments include a plurality of pairs of gripping members mounted together as a single unit mounting body. In some embodiments in which a plurality of pairs of gripping members are mounted together in a single unit, each pair is individually adjustable to permit a single piece of equipment to be placed in and/or removed from the rack without interfering with any other equipment that is being held by the rack by the other pairs.

In several preferred embodiments of the instant invention, the gripping members are made adjustable via an adjustable rod assembly that connects each pair of gripping members together. In such embodiments, equipment such as snowboards or skis may be located between the pair of gripping members and the adjustable rod assembly is then rotated to bring the gripping members together to grasp the edges of the equipment. In several such embodiments the gripping members (talons) are mounted onto and/or formed as part of a bracket body that is connected to an adjustment rod assembly. Rotation of the adjustment rod assembly causes the pair of bracket bodies and/or associated talons to move together and/or apart. In several embodiments, the adjustment rod assembly is threadingly engaged to both bracket bodies of each pair of bracket bodies. In such embodiments, left-hand threads are utilized on one end of the adjustment rod assembly and right-hand threads are utilized on the opposing end of the adjustment rod assembly such that rotation of the adjustment rod assembly causes the pair of bracket bodies to move laterally in opposite directions in relation to each other (i.e. either together or apart), in a manner similar to a turnbuckle. In other embodiments, the adjustment rod assembly is threadingly engaged with only one of the bracket bodies of each pair. The other bracket body is mounted to a non-threaded portion of the adjustment rod assembly such that that bracket body and the adjustment rod assembly can freely rotate and/or move laterally with respect to one another. In one such embodiment, a spring positioned between the pair of bracket bodies urges the pair of bodies apart from one another. As the adjustment rod assembly is rotated in one direction, the threaded bracket body moves laterally toward a first end of the adjustment rod assembly, which causes the threaded bracket body to move away from the non-threaded bracket body. As the adjustment rod assembly is rotated in the other direction, the threaded bracket body moves toward the other end of the adjustment rod assembly, toward the non-threaded bracket body, which is retained onto the adjustment rod assembly via a flange at the non-threaded end of the adjustment rod assembly. It will be appreciated that the embodiments of the instant invention utilizing adjustable gripping members in the manner described above may be utilized and/or adapted to hold sports equipment in a variety of orientations. For example, in some embodiments of the instant invention, the gripping members are specifically designed to engage opposing edges of skis or a snowboard while the skis or snowboard are orientated laying flat (i.e. as though they are being used or worn by a skier or snowboarder) between the gripping members. In such embodiments the generally parabolic shape or other similar shape in which the center of the body is narrower than one or both ends (front and back when in use by a skier or snowboarder) cause the equipment to be retained between the gripping members when they are brought together and prevents removal of the equipment unless the gripping members are moved apart (assuming both ends of the piece of equipment are wider than the middle). In other embodiments, the gripping members are designed to grasp an end of the equipment (such as the generally curved front/tip of a ski or snowboard) by retaining the top and bottom surfaces (top and bottom in relation to a skier or snowboarder) of the equipment between the gripping members.

In other preferred embodiments, the gripping members are made adjustable via a ribbon assembly (or rack and pinion assembly) that connects each pair of gripping members together.

In other preferred embodiments, the gripping members are made adjustable via a rail system including talons that can be repositioned at various locations along the rail. In some embodiments the adjustable/repositionable talons are inserted at an end of the rail, such that the talons are only repositionable by sliding along the rail (either individually by hand, or in combination via an adjustable rod assembly as is discussed above). In other embodiments the talons may be inserted within the rail at any location along the rail, such that adjustments may be made by removing a talon from the rail and repositioning that talon to the desired location. In operation, a pair of talons are positioned an appropriate distance apart from one another such that a narrower portion of the body of the equipment being held can be inserted between the talons (i.e. the distance between the talons is greater than the width of the narrowest portion of the ski, snowboard or other equipment being held therebetween) and as the equipment is positioned between the talons the talons will grip the edges or surfaces of the equipment along the wider portion of the equipment (i.e. the distance between the talons is less than the width of the widest portion of the ski, snowboard or other equipment being held therebetween).

In other preferred embodiments of the instant invention, the gripping members are both located a fixed distance apart from one another. In such embodiments, the gripping members are shaped and positioned in such a manner that the gap between the pair of gripping members generally forms the profile of the equipment being held (such as the profile of the tip of a ski or snowboard). In one embodiment in which the gripping members form a profile for holding the generally curved tip of a snowboard or ski, the mounting body of the invention is a single generally box-shaped solid member with a curved profile or groove cut horizontally into the solid member, but not all the way through. The profile approximates the profile of a snowboard's or snow ski's tip, with the opposing surfaces of the groove being the pair of gripping members. The ski or snowboard is placed within the groove by sliding the tip into the open end of the groove. In a preferred embodiment, a repositionable flap is used to cover the open end of the groove and hold the ski, snowboard or other equipment within the groove.

In several preferred embodiments of the instant invention, the mounting body for the gripping members is rotatably adjustable with respect to the surface on which it is mounted. It will be appreciated the rotatable mounting body assembly of the instant invention may be utilized in combination with any embodiments of the invention discussed herein.

In other preferred embodiments, locking assemblies secure the equipment within the gripping members. In several such embodiments, the locking assembly includes special locking talons.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the sports equipment rack and individual components thereof is disclosed herein that are specifically designed for holding snowboards and/or skis; however, it is to be understood that the disclosed embodiment is merely exemplary of the principles of the invention, which may be embodied in various forms, including, but not limited to those embodiments disclosed in copending U.S. Provisional Patent Application Ser. No. 61/222,550, filed Jul. 2, 2009, the entire disclosure of which is incorporated herein by reference. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
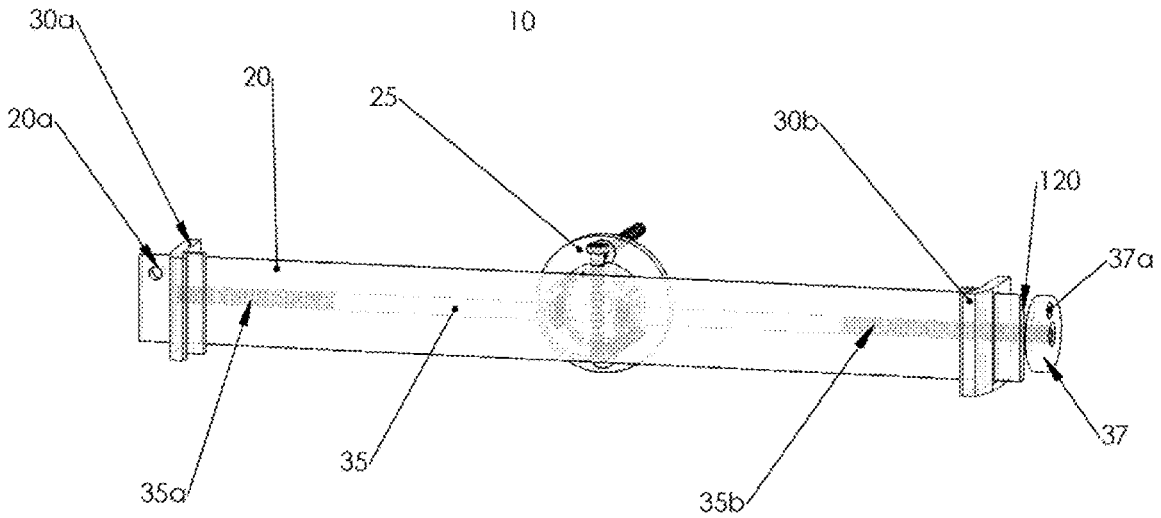
FIG. 1 is partially transparent front perspective elevation view of an equipment rack of an embodiment of the instant invention.
Figure 2:
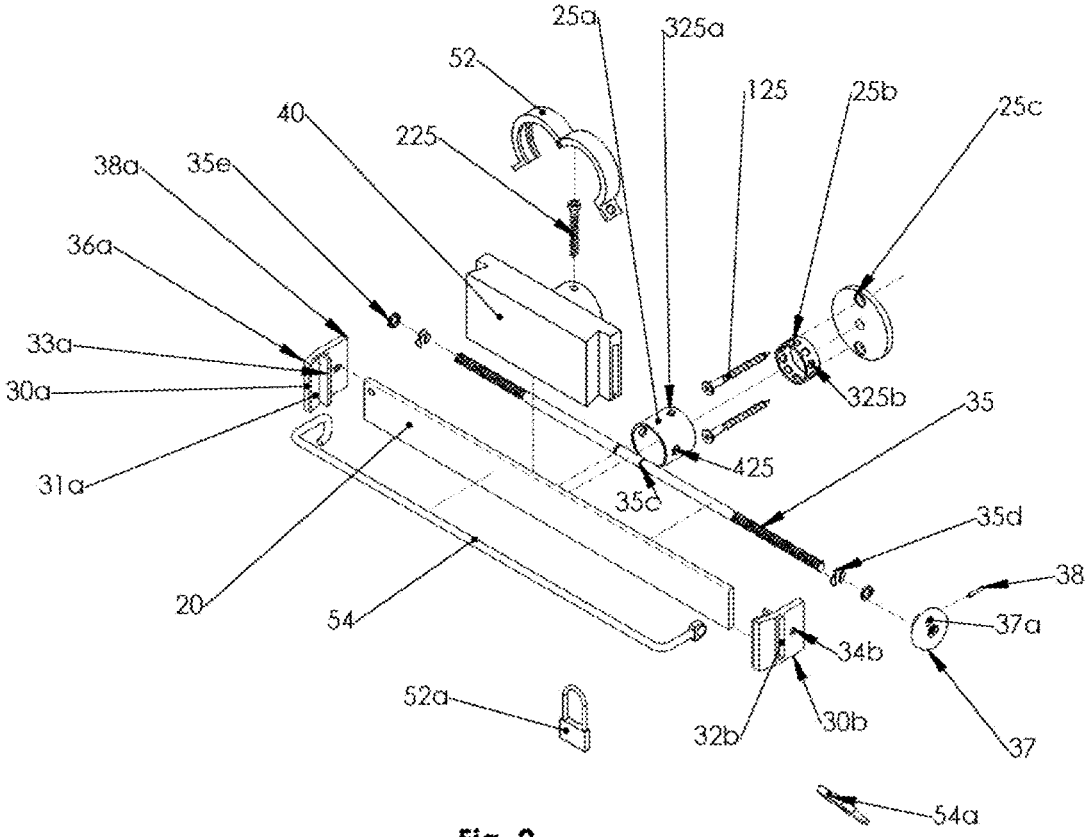
FIG. 2 is front perspective exploded view of the equipment rack of FIG. 1 that further includes a ski component of an embodiment of the instant invention.
Figure 3A:
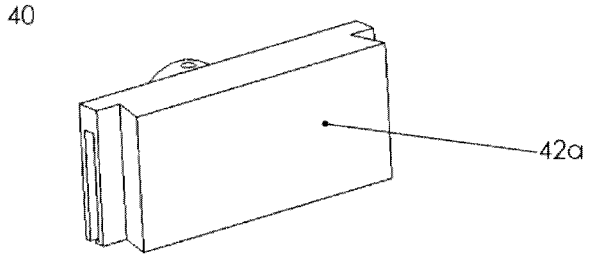
FIG. 3*a* is a front perspective view of the ski component of FIG. 2.
Figure 3B:
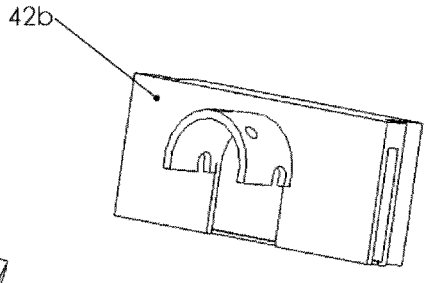
FIG. 3*b* is a rear perspective view of the ski component of FIG. 2.
Figure 3C:
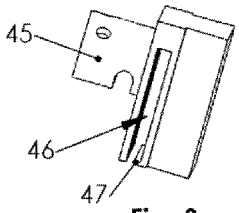
FIG. 3*c* is a side perspective view of the ski component of FIG. 2.

Referring to FIGS. 1 through 3, an embodiment of an equipment rack 10 of the instant invention is shown. FIG. 1 shows rack 10 fully assembled with a ski component and locking members (discussed below) removed. FIG. 2 shows an exploded perspective view of rack 10 and all components, including the ski component and locking members that are removed in FIG. 1. FIGS. 3*a* through 3*c* show detail views of the ski component.

Rack 10 includes rail 20 (shown in FIG. 1 as transparent for explanatory purposes), gripping members (or talons) 30*a* and 30*b* adjustably mounted to rail 20, adjustable rod assembly 35 for adjusting the position of gripping members 30*a* and 30*b* along rail 20, and mount 25 for rotatably attaching rail 20 to a wall, post or other fixed object.

Rail 20 provides a rigid fixed length support/framework for rack 10. Nevertheless, it will be appreciated that in alternative embodiments, the length of rack 10 will vary based upon the adjusted position of gripping members 30*a* and 30*b* along rod assembly 35. It will further be appreciated to in such alternative embodiments, the design of the gripping members and/or rod assembly may vary from those shown in FIGS. 1-3. For example, in one embodiment, the gripping members include a body width (or bracket body width, discussed further below) that is large enough to fully surround the threaded length of the end of the rod 35 such that the rod extends into the body to contract the distance between the gripping members, and extends outward of the body to extend the distance between the gripping members. In some such embodiments, a tool, such as a key or screwdriver, is inserted into the body from an exterior end to engage and rotate the rod. The fixed length support provided by rail 20 of the embodiment shown in FIGS. 1-3 provides added rigidity to rack 10, and combines with additional security features/locking members (discussed further below), to help prevent removal of the item being held by rack 10 from the rack and/or removal of rack 10 from the object to which it is mounted.

In the embodiment shown in FIGS. 1-3, gripping members 30*a* and 30*b* each fully wrap around rail 20 via slots 32(*a* and *b*, respectively) that extend through gripping members 30*a* and 30*b*. This allows the downward force exerted upon gripping members 30*a* and 30*b* from the item of sports equipment (such as a snow board, ski(s), etc.) being held within gripping members 30*a* and 30*b* to be fully or at least substantially exerted upon rail 20 rather than upon rod assembly 35. Rail 20 supports the gripping member in all three axes. In the embodiment shown, the slot (32*a/b*) is cut into the gripping members (30*a/b*) is a slightly taller than the height of rail 20 to permit limited rotation about the Z-axis (up/down when locking at rack 10 in FIG. 1). This rotation allows for a better "fit" against a tapered snowboard being held between gripping members. Furthermore, in the embodiment shown, the gripping members each include a tapered interior surface 31(*a/b*, respectively), that tapers inward generally from the posterior end 38(*a/b*, respectively) toward the anterior end 36(*a/b*, respectively) of the gripping member 30(*a/b*, respectively). In this manner, the gap created between gripping members 30*a* and 30*b* is wider toward the posterior ends of the gripping members and narrow toward the anterior ends. This allows gripping members 30*a/b* to wrap around a snowboard or other item being supported and aids in preventing removal of the item by exerting a force on the item outward from the rack (i.e. from the posterior to the anterior of the gripping members. In the embodiment shown, the gripping members each include a spacer member 33(*a/b*, respectively) that protrudes inward and generally orthogonal to the body of the gripping member 30(*a/b*). This spacer creates a protective barrier between rail 20 and the snowboard or other item being held between gripping members 30(*a/b*). Also, in the embodiment shown, the taper discussed above generally starts from the spacer member 33(*a/b*) and tapers inward toward the anterior end 36(*a/b*) of the gripping members 30(*a/b*).

In the embodiment shown in FIGS. 1-3, gripping members 30*a* and 30*b* are each of a unitary construction, such that the body of each gripping member, slots through the body, spacer member and tapered portions are all integral with each other. Notwithstanding, it will be appreciated that in alternative embodiments, the gripping members are constructed of multiple separate components, including (but not necessarily limited to) a talon portion (tapered portion) and a bracket body portion. In some such embodiments, the talon head (contact piece with the item being held) swivels on the bracket body (part that intersects the rail), to allow for a better "fit" with the item being held. In a preferred embodiment, the gripping members are made of a steel or other high strength metal material and our coated with HDPE or rubber to protect and/or better grip items being held between the gripping members. Nevertheless, it will be appreciated that the gripping members may be made of any suitable material now known or hereafter developed. For example, in some embodiments, the gripping members are made entirely of HDPE.

Mount 25, includes an outer rotator ring 25*a* fixedly connected to rail 20, and an inner rotator ring 25*b* fixedly connected to mounting plate 25*c* Inner rotator 25*b* fits within outer rotator 25*a* and are capable of rotating with respect to each other (creating a RAM, discussed below). Screw 225 extends through mating holes (325*a/b*, respectively) in outer rotator 25*a* and inner rotator 25*b* to lock the pieces together and prevent rotation. Mounting plate 25*c* is attached to a wall or other fixed object via screws 125 that extend through holes in mounting plate 25*c*.

In the embodiment shown, the anterior face of the outer rotator 25*a* is welded to the posterior face of the rail 20. The outer rotator component 25*a* serves several functions. First, the adjustment rod 35 passes through holes 425 in outer rotator 25*a*, such that outer rotator 25*a* supports rod 35. Outer rotator 25*a* also houses the E-Clips 35*d*, and restricts the distal movement of the Washers 35*e*, which rotatably secure rod 35 to outer rotator 25*a*. Outer rotator 35*a* further includes four circumferential holes 325*a* on one plane. These holes are divided into two sets of two. The holes create two separate positioning paths for insertion of the rotator screw 225. The first hole (located toward the top of rotator 25*a*) of each path is not threaded, the second hole is threaded.

The most important function of the outer rotator and inner rotator combination is to connect the rail 20 to the mount 25*c*, via the rotator screw. When joined, the inner rotator 25*b* is nested within the outer rotator 25*a*. The Adjustment screw passes straight through both components twice (once on each opposing side).

The positioning paths of screw 225 (Path 1 and Path 2) are established in a manner to ensure that the number of rotatable positions for the device will equal twice the number of evenly spaced holes 325*b* drilled into the inner rotator 25*b*. When the rotator screw 225 is in position for path 1, the other entry hole 325*a* (for path 2) on the outer rotator is circumferentially spaced exactly ½ off from a hole from an entry position 325*b* into the inner rotator. In the embodiment shown, the inner rotator has ten holes 325*b*, therefore the device has twenty different rotational hanging angles. Nevertheless, it will be appreciated that the number and spacing of holes may vary without departing from the spirit and scope of the instant invention.

The outer circumference of the outer rotator partially covers the heads of the mounting screws 125. When the outer rotator is "pinned" in place (i.e. screw 225 is inserted), the heads of the mounting screws are not accessible for removal. In the preferred embodiment, a minimum of two mounting screws are utilized for each assembly. These screws attach the mount 25 to the mounting surface (wall, ceiling, post, etc.). In the shown embodiment, a third screw can be added (screw not shown, but screw hole shown at center of plate 25*c*) to decrease the chance of theft. If someone tries to steal the entire device by rotating a distal end of a held board (or other item) along the z-axis, an incredible amount of torque can be produced. Depending on the length of the board, enough force could be generated to pull the screws from their mounting surface, or even shear the screws in two. A third (centered) mounting screw could survive unaffected, still attaching the device to the mounting surface. The likelihood of this leveraged torque removal is further decreased as the mounting hole spacing distances increase on the mounting plate 25*c*.

The posterior face of the inner rotator 25*b* is centered on, and welded to, the anterior face of the mounting plate 25*c*. In the embodiment shown, inner rotator 25*b* has ten evenly spaced, circumferential, holes existing on one plane. The Inner Rotator stays in a fixed position. The outer rotator rotates around the inner rotator, to change mounting positions.

In the embodiment shown, the mounting plate 25*c* is shown as a flat disk. Nevertheless, it will be appreciated that other shapes (including but not limited to square, rectangular, circular, oval, half-circle, etc.) may be utilized without departing from the spirit and scope of the invention. Furthermore, it will be appreciated that a non-rotating mount 25 may be utilized. In one such embodiment, outer rotator 25*a* and inner rotator 25*c* are square shaped. In one such embodiment inner rotator 25*c* includes a mounting plate within the interior of the square shape, such that the mounting plate is not visible once the rack is installed at its fixed location. In the embodiment shown, the mounting plate 25*c* is used to attach the device to the mounting surface.

The rotator screw 225 is used to lock the two rotators (inner and outer) in position once a desired hanging angle is achieved. The screw 225 may have a head or be headless, but, in a preferred embodiment must have an unthreaded upper shank. This upper shank fits closely with the entry holes of the outer rotator and inner rotator. The shank helps limit the amount of force placed on the threads when rotational forces are applied to the device.

The adjustment rod 35 includes right hand threads 35*b* for threadingly engaging female right hand threads of right gripping member 30*b*, and left hand threads 35*a* for threadingly engaging female left hand threads of left gripping member 30*a*. The rod controls the position of the gripping members along the length of rail 20. Restriction of the rotation of the adjustment (via a locking member, discussed below) is a key security feature of the instant invention. If the rod cannot be turned, the position of the gripping members will not change, and the snowboard, or other item being held between the gripping members cannot be removed.

Rod 35 extends through holes 425 and is held within outer rotator 25*a* via 3-clips 35*d* that rest within grooves 35*c* in rod 35. One clip rests within each groove, which has been cut into the rod 35. There are two grooves in each rod. These clip to groove relationships, establish the lateral limits that adjustment rod can travel, generally preventing lateral movement of the rod 35 to the rotator. In this manner, as the rod rotates, it results in lateral movement of the gripping members. The washers 35*e* act as a buffer between the curved inside wall of the outer rotator 25*a* and the E-Clips 35*d*. This help to prevent premature failure of thee e-clips that may result when the concave walls of the outer rotator are pressed directly against the lateral sides of the E-Clips.

The knob 37 is used to initiate rotation of the rod 35. As is discussed above, rotation of the adjustment rod translates into lateral movement of the gripping members. An off-center x-axis hole 37*a* is cut into the head of the knob 37. A lock shank from lock 54*a* (locking member) may be placed into this hole to limit the maximum rotation of the knob to ½ turn, as the shank will not fit within the limited sized gap 120 between the outer circumference of the knob head and the rail 20. In addition, the limited sized gap created between the knob head and the wall, or other object to which the rack 10 is mounted, will further prevent rotation of the knob head when lock 54*a* is in position, as the shank cannot fit through such gap.

In the embodiment shown, knob 37 is attached to rod 35 via a tapered pin 38 that extends through the knob 37 and the rod 35. In an alternative embodiment, a set screw extends through on side of the know and engages the surface of the rod to hold the knob to the rod. In the embodiment shown, placement of the hole/holes for the taper pin or set screw prevents access to the pin/screw when the knob is in a locked position. The location is such that when the lock is within the knob, the pin/screw is blocked by the rack, the wall it is mounted to, and/or the item positioned within the rack.

The Ski Component 40 shown in FIGS. 2 and 3 is used hold snow skis within rack 10. The ski component 40 is pushed down onto the rail 20 and then secured with the rotator screw 225 that also is used to secure inner and outer rotators 25*a* and 25*b* to each other. The ski component 40 includes a generally cylindrical sleeve 45 that at least partially surrounds the outer rotator 25*a*, and a gripping member portion 42 that is associated with said sleeve (the sleeve protrudes from the rear portion 42*b* of the gripping member portion). The gripping member portion 42 is positioned along said rail between the gripping members 30*a* and 30*b*. The gripping member portion includes a slot 46 in which the rail 20 is located when the ski component 40 is positioned on rack 10. A small ridge 47 located on the bottom of the slot protrudes in a posterior direction from a frong portion 42*a* of the gripping member portion to help to lock the ski component 40 into place on the rail 20. The Ski Component does not interfere with any function or feature of the device.

A locking ring 52 is used as another locking member to prohibit access to the rotator screw 225 and mounting screws 125. In the embodiment shown the ring comes is a two-piece hinged version; however, it will be appreciated that in an alternative embodiment, the ring is a single curved band with locking holes on each end. The ring 52 surrounds the outer rotator 25*a*, as well as the sleeve 45 of the ski component 40 (if utilized), and the rotator screw 225, such that the rotator screw cannot be removed when ring 52 is in place. A lock 52*a* is placed through the holes at the ends of the ring 52 to prevent removal of the ring from rack 10.

Still another locking member in the embodiment shown is the locking bar 54 which is designed to deter theft of the board (or other item) from the rack 10. One end of the bar passes through hole 20*a* in rail 20 and bends around rail 20 when in an engaged position. The other end of the bar aligns with the lock hole 37*a* cut into the knob 37. The locking bar 54 extends across the item being held within the rack to prevent removal of the item from the rack when the bar 54 is in locked/engaged position.

In preferred embodiments, one or more of the locking members discussed above are utilized in conjunction with a coin-operated locking system. Such a system is beneficial for use of the rack of the instant invention in public locations, allowing the racks to be rented for use by individuals desiring temporary and secure storage of their item(s). It will be appreciated that integration of a coin operated mechanism with the locking members of the instant invention will be readily apparent to those of ordinary skill in the art. In one embodiment, the coin mechanism is connected to the rod 35, such that rotation of the rod 35 is prevented and/or enabled upon insertion of a coin, and alternatively either enabled or prevented upon insertion/removal of a key.

Although shown as a rack for a single item (or pair of skis) that includes only a single adjustment mechanism for one pair of gripping members, it will be appreciated that in some embodiments the rack of the instant invention will include multiple pairs of gripping members on a single rail 20. In such embodiments, multiple outer rotators 25*a* are spaced along rail 20 to support multiple rod assemblies 35. It will be appreciated that in a multiple rail assembly some adjustment assemblies may only include an outer rotator 25*a* and not an inner rotator 25*b* or mounting plate 25*c*. For example, in an assembly including 3 adjustment mechanisms (and 3 pairs of gripping members) spaced along a single rail 25, the two end adjustment mechanisms will included the wall mount assembly (i.e. inner rotator and mounting plate), but the middle adjustment mechanism only includes the outer rotator to support the rod.

Various components similar to those discussed above of a number of alternative embodiments of the instant invention are discussed below in further detail.

A Mounting Body (MB) serves several functions. First, it fastens the entire rack assembly to the wall or other mounting surface. Second, it serves as a strong, central, fixed body, from which all other components (discussed below) are either directly or indirectly attached. Third, it provides a stand for the Adjustment Rod (discussed below) and restrains the Adjustment Rod from all but rotational movement. Fourth, it serves as the central point relative to which all components move.

Preferred embodiments of three types of Mounting Bodies are described and shown herein.

Type 1 resembles a solid block with a round horizontal hole cut through it, through which the Adjustment Rod (AR) is located.

Type 2 consists of a low profile rectangular block with two Restraint Towers (RT) rising perpendicular from the surface of the distal ends of the block. The Restraint Towers are square blocks with horizontal holes cut through them. Each hole encircles part of the AR.

Type 3 is a multiple component assembly referred to herein as a Rotating Adjustable Mount (RAM)(discussed below). This type of mount is capable of rotation along its Z-axis. It will be appreciated that a RAM Mounting Body can be constructed on type 1 or type 2 Mounting Body frameworks discussed above, or in connection with other frameworks now known or hereafter developed.

It will be appreciated that all of the Mounting Bodies discussed above may be constructed to accommodate the rail systems and/or locking assemblies discussed below, as well as any other rail systems or locking assemblies now known or hereafter developed.

The Rotating Adjustable Mount (RAM) provides the ability to store and display snowboards and skis on a rack assembly of the invention described herein at various angles on the Z-axis. In one embodiment, by pressing the mounting body toward the wall (or other surface in which the Mounting Body is mounted), the Mounting Body is free to rotate, until the pressure is released. The RAM is compatible with all assemblies, and/or sub-assemblies of various embodiments of the instant invention discussed herein, as well as other embodiments of the invention now known or hereafter developed. The advantages of storing or displaying a snowboard on a rotary mount is primarily aesthetic, but on occasion may also take better advantage of a given space in which the rack assembly is located.

The RAM includes a RAM Body and a Mounting Plate. The Mounting Plate serves two primary purposes. First, The Mounting Plate contains Attachment Tabs with mounting holes that are used to attach the entire RAM to a Wall or other vertical surface in the same or similar manner to the Mounting Bodies discussed above. Second, The Mounting Plate is responsible for maintaining a fixed reference position that the RAM Body pivots upon.

The Adjustment Rod (AR) prohibits travel of the Bracket Bodies (discussed below) in the Y and Z-axis, and controls their travel in the X-axis. Rotation of the AR provides the means by which the Bracket Bodies and subsequent talons (discussed below) are moved toward or away from one another. The AR also prohibits the two Bracket Bodies from being forced away from one another, when a ski or snowboard is placed in the device.

In one embodiment, the AR resembles a long cylinder with threads on each end. In preferred embodiments, at minimum every AR consists of a central body, a left and right collar, and a left and right arm. The left arm is left hand threaded, while the right arm is right hand threaded. The threads of each arm are mated to reciprocal threads found within their respective Bracket Body. In some embodiments, the AR threads are female threads and the Bracket Body threads are male threads, and in other embodiments the AR threads are male threads and the Bracket Body threads are female threads.

Two types of AR collars are utilized in connection with the embodiments of the invention discussed herein. The first collar type consists of an extrusion ring rising outward from the surface of the rod. The second collar type is a simple "C" ring that sits in recessed grooves cut into the circumference of the bar.

There are four basic designs for AR 1, AR 2, AR 3, and AR 4 (Adjustment Block) with the embodiments of the instant invention discussed herein.

AR 1s can be used with any type Mounting Body discussed herein. Rotating one tip of the AR with either an attached flange or a screwdriver bit turns this type of AR. Some flange style AR 1s also serve as locking components.

AR 2s work with Type 2 Mounting Bodies discussed above. An AR 2's central body section is used to rotate the rod. This design places both collars either immediately outside or inside of, each MB restraint towers.

AR 3s use an intermediary Turn Key (TK) to initiate AR rotation. The Turn Key resides between the internal cavity of the Bracket Body and the distal section of one AR arm. AR 3s can be used with all types of Mounting Bodies discussed herein.

The AR 3/Turn Key method offers several advantages. One, the handle of the Turn Key serves as a locking component. A lock can be inserted through the hole in the handle. Once the lock is in place, the rotational range of the Turn Key is limited. Two, the distance from the Turn Key to the distal face of the Bracket Body never changes. This maintains an aesthetic continuity for the assembly, at any point in its range of motion.

AR 4 is not a rod but a centrally located, threaded, block that pivots around two male threaded Bracket Body-Rods.

In some embodiments of the instant invention Electronic Adjustment Actuators (EAA)s are used to rotate the ARs discussed above. An EAA is comprised of three primary components, a small DC motor, a battery, and an electric switch. The small electric motor is used to rotate the Adjustment Rod (or Rods). In preferred embodiments, the EAAs are mounted on (or within) the Mounting Body, or Bracket Body.

In some embodiments, centrally located EAAs are mounted horizontally and have a rotatable shaft emanating from both ends of the motor. In certain embodiments, these shafts serve as Adjustment Rods and/or they interact with Adjustment Rods, controlling the lateral movement of the Bracket Bodies.

In some embodiments Bracket Body EAAs have only one shaft. In alternative embodiments, they have a second shaft, which interacts with a locking mechanism.

It will be appreciated that EAA's may be incorporated into any of the embodiments of the invention described herein.

In some embodiments of the instant invention, the Adjustment Rod directly controls the movement of only on of a pair Bracket Bodies, as opposed to directly controlling both as in the embodiments discussed above. Only one Bracket Body has internal threads and interacts directly with the Adjustment Rod. The other Bracket Body's hollow chamber simply acts as a conduit for the Adjustment Rod to pass through.

A rectangular "C" channel encompasses the moving parts of the assembly. The Mounting Body is attached through the center of the C channel, and into the wall.

The Adjustment Rod only controls the distance between the two Bracket Bodies. Each Bracket Body's position is influenced by compression springs, located between each Bracket Body and the centrally located Mounting Body. The Adjustment Rod limits the distance that the springs can force the two Bracket Bodies apart. This dual spring tension balances the lateral position of each Bracket Body relative to the Mounting Body.

In several embodiments of the invention, a cylindrical version of the Single Thread design requires no Mounting Body at all. Only a spring sits between the two Bracket Bodies. A setscrew is inserted into the bottom of one Bracket Body to limit the range of the brackets within the cylinder. A slotted segment is also cut into the bottom of the Cylinder to allow the setscrew to travel. This cylindrical version is enclosed in a true C channel housing. In a preferred embodiment a Mounting Block is attached to the back of the C housing to help secure it to the wall. The Mounting Block is mounted to the wall, and then the housing is bolted to the Mounting Block.

In alternative embodiments of the invention, a rack and pinion type (or Ribbon Assembly) assembly is used to control the travel of Bracket Bodies, instead of the AR's discussed above. To move the Bracket Bodies horizontally a centrally located rotary dial is pressed in, and then turned. Once the Bracket Bodies are in the desired position, stop applying inward pressure to the dial.

The assembly is centered around a hollow, rectangular, horizontal tube referred to herein as a Containment Tube. The tube has a rotary gear profile cut through the center of one of its faces. A barrel shaped rotary gear sits within this opening, protruding into the cavity. When turned, the gear's splines mesh with and drive two long moveable tracks. A Bracket Body is attached to the distal end of each Track.

An Adjustment Cap is bolted to the head of the Gear Body. The actual Adjustment Dial is located on this cap. This cap also establishes one extreme of the Gear Body's travel in the z-axis. In a preferred embodiment, the Gear Body is separated from the cap to simplify manufacturing the entire assembly.

As mention above, the hole that is cut into the face of the Containment Tube matches the profile of the Gear Body. When the assembly is in a relaxed state, a portion of every spline on the Gear Body, is contained within that opening. Simultaneously, a portion of some of those splines meshes with the splines on the Tracks. This pairing prohibits the Gear Body from turning.

To disjoin the pairing, press the Adjustment Dial until the splines disengage the wall of the Containment Tube. The top of the Gear Body has smaller diameter neck, which has no splines. When this neck is positioned within the opening, only the Tracks mesh with the Gear Body's splines.

In a preferred embodiment a Face Plate is used to limit the z-axis range of the Gear Assembly. This opening in this plate is only large enough to accommodate the neck of the Gear Body. Other embodiments use a raised ring on the back of the Gear Body to achieve the same result. In such embodiments, the rear of the Containment Tube has a stepped hole and the Face Plate is applied to the back of the Containment Tube. In addition, the splines on the Gear Body and the tracks are altered in such an embodiment.

In another embodiment the diameter of the Gear Body's neck is smaller than the diameter of the rest of the body and splines are added to a small portion of the Gear Body's neck. These splines fit into a reduced version of the hole discussed in the above embodiment. This step between the Gear Body's neck and body provides a forward limit of travel in the z-axis for the Gear Body. The larger diameter of the body will not fit through the reduced diameter of the hole.

Bracket Bodies (BB) mount on both ends of each AR. In several embodiments, each BB has a threaded conduit running horizontally through the center of its body. In such embodiments, the left Bracket Body is left hand threaded, the right BB is right hand threaded. The conduit's threads interface with the threads of the Adjustment Rod. Each Bracket Body serves several functions, they:

1. Act as intermediaries to transform the rotary motion of the AR into linear movement of the Bracket Bodies along the X-axis. This linear travel allows the entire assembly to adjust for different width snowboard waists.

2. Act as strong attachment blocks for other components, such as talons (gripping members), Locking Assemblies, and Rails.

3. Establish a posterior limit for the bottom sheet of the boards being held in the device.

4. When used with a Rail System, they bear some of the weight of the snowboard, which reduces the amount of downward force applied to the Adjustment Rod and Mounting body.

It will be appreciated that all Bracket Body types discussed herein can be designed to integrate with any of the rail systems and/or locking assemblies/members discussed herein, as well as any other suitable rail systems or locking assemblies now known or hereinafter developed.

Talons are the gripping member components of several preferred embodiments of the invention that directly interface with the lateral edges (or top/bottom surfaces) of the board or skis being held in the device. Two embodiments of Talons, fixed and rotary, are described in connection with the embodiments of the invention described herein.

Fixed Talons are static to the Bracket Body, and in some embodiments are be formed as one solid portion of the Bracket Body, as in the case of a Bracket Talon. Rotary Talons rotate about the z-axis from the anterior face of the Bracket Body. Talons are used in connection with AR adjustable assemblies discussed above as well as rail assemblies discussed below.

Several embodiments of Talons have flat or rounded medial faces, which interface with the board being held. Other embodiments of Talons have medial faces that are at least partially slanted on the Z-axis. The anterior face of the Talon extends further medially than the posterior face does. When a board is mounted in the device, this slanted face causes the board to be wedged fore and aft between the anterior surface of the Bracket Body and the Talon's medial face. Another important function of the slanted face is to create an anterior barrier/limit for the board when the board is locked in the device.

Rotary Talons have the ability to rotate with respect to the Bracket Body, which creates a better alignment for the fit between the medial Talon face and the lateral edge of the board being held. It will be appreciated that Rotary Talons can be connected to the Bracket Body in many ways. In many of the embodiments shown and described herein, the Talon and Bracket Body share some form of male-female relationship, supported by a pattern of complimentary threads formed in each. Depending on materials of specific embodiments this male-female relationship is maintained with or without threads. In other embodiments, the two components are also joined together using screws or rivets. In other embodiments, the components are pressed together, or slots and flanges are placed onto both so that the talon can be turned 180 degrees from its "normal" position, and inserted onto the Bracket Body, then rotated in to the "normal" position. This allows the Talon to rotate through its normal range of "in use" motion (roughly 20 degrees in preferred embodiments), and still stay connected to the Bracket Body.

In some embodiments in which a wide enough Mounting Body is used, Talons are mounted directly onto Adjustment Rods, without a need for Bracket Bodies.

Several embodiments of the invention include a Basic Turnbuckle design, in which the centrally located Adjustment Block, rotates around the medial ends of the two oppositely threaded Rods. One Talon is joined to the distal end of one Rod to form a single component. When the Adjustment Block is rotated, the threaded ends of the rods move laterally within the Block.

Rail systems are fixed tracks to which an individual mounting assembly and/or a plurality of mounting assemblies and/or pair(s) of talons are mounted. There is a linear male to female relationship, between the anterior face of Rails and the posterior face of a Mounting Bodies and Bracket Bodies.

Rail Systems serve several purposes. First, they allow for the alignment and organized expandability of individual devices into groups. Second, rails increase the functional lateral stability of each device. When the Bracket Bodies are moved distally to accept wider snowboards, the Bracket Bodies are moved further apart from one another and the adjustment rod's fulcrum. This widening increases the downward force that is applied to the distal ends of the Adjustment Rod, via the Bracket Bodies. The Rail System alleviates most of the stress that would be applied to the adjustment rod, by bearing the stress directly from the Bracket Body.

In one preferred embodiment, the rail assembly is applied to a corner mount configuration. In addition to holding skis and snowboards, one preferred embodiment of the corner configuration also contains a shelf.

In preferred embodiments, the rail assemblies also hold hooks that are used to hang gear.

In another embodiment, the rail assembly is used to replace the Mounting Body. One embodiment of a rack of the instant invention includes an AR without a Mounting Body component. Because of the rail assembly, the Mounting Body component is not required in such embodiment.

The Locking assembly/member of preferred embodiments discussed herein may be used with individual mounting assembly and/or plural mounting assembly devices formed as a single unit. The primary linkage component between the Locking Assemblies and the devices are their Talons. The anterior face of any Talon design is modified to accept a Locking Assembly Link Pin. Talons that support the Locking Assembly are known as Locking Talons. A Locking Talon's anterior face has either a male protrusion (threaded in preferred embodiments), or a female indentation (threaded in preferred embodiments). These protrusions or indentations are complimentary with features found on the Locking Assembly Link Pin. In some embodiments, a portion of the Link Pin is connected to a Locking Arm, which is indirectly locked to a second Link Pin, located on the other Locking Talon.

Another embodiment of Locking Talon includes the Link Pin formed as part of the Talon. This allows for the attachment of the Locking Assembly's locking arm and Receiver Pin as the Talons are attached to the Bracket Bodies.

In some embodiments an Adjustment Tool aids in the turning of Adjustment Rods. When not in use, the tool hangs passively in a recessed portion of the Adjustment Rod. When needed, the tool can be moved laterally until it engages a "fitted" portion of the Rod. The tool enables the user to increase the amount of torque applied to the Adjustment Rod.

In some embodiments Locking flanges are attached to Glide Plates, Talons, and Bracket Bodies to prohibit disengagement of the interlocking surfaces. In a preferred embodiment, these flanges are used in conjunction with an Adjustable Locking Bar to give the user the option to lock the position of both Bracket Bodies.

It will be appreciated that the standard Locking Assembly discussed above may also be mounted to the Talons and Bracket Bodies used with this design.

The Slotted Rail is the main platform for certain preferred embodiments of rail mounting assemblies, which may be utilized to hold a single piece of sports equipment, or preferably a plurality of pieces of equipment on a single rack. The rail serves as the mounting body and locking interface for all Talons. No Adjustment Rods or Bracket Bodies are needed in these embodiments. Once the Talon is on the rail, it's posterior fins fit into the slots cut into the rail and prevent lateral movement of the Talon. In some embodiments, the Talon is fashioned to have female depressions in its posterior fin plate, which interface with male protrusions on the Rail.

Talons of preferred embodiments of the invention are divided into two groups, Adjustable Talons and Insertable Adjustable Talons. Preferred embodiments of both groups include flat or rounded medial faces and include static or rotary designs.

Adjustable Talons can only be inserted into and removed out of a rail's lateral sides.

Insertable Adjustable Talons (IAT) are extracted out of and inserted into Slotted Rails, through the rail gap present on the anterior face of all Slotted Rails. This allows for the quick and easy addition or subtraction of talons, without having to rearrange other pre-existing talons and components that may populate the rail.

Consider the position that a talon "normally" takes while sitting on a slotted rail, to be its "normal" X, Y, and Z-axis positions. To place an IAT onto a rail, begin in the normal position. Rotate the talon about 15 degrees on the X-axis, then 90 degrees on the Z-axis. Next, position the Insertion Barrel of the talon between the upper and lower Channel Walls, The talon can then be returned −90 degrees back to its previous Z-axis position. During this rotation, the shape of the talon's Channel Plate will contact the posterior sides of the upper and lower channel walls and direct the talon back toward a "normal" talon position.

The exact dimensioning of the IAT's body features, along with those of the Slotted Rail, will determine how sloppy or tight of a fit these components will incur during the insertion process. The choice of component materials will also influence this procedural fit.

One embodiment of an IAT contains two additional body features, a Rail Shield, and a Rail Hook. It will be appreciated that each of these features may be used individually or in conjunction with one another.

The Rail Shield provides a protective surface for the base of the snowboard or ski to rest against, in case the Slotted Rail is composed of a material that is abrasive or potentially damaging to the board's base.

The Rail Hook extends beneath the Slotted Rail and helps prohibit the Talon from rising out of position, when a snowboard or ski is lifted upward before it disengages from the talons.

Aside from the mechanical properties of the talons, preferred embodiments also come in a variety of aesthetic shapes and designs. To mention just a few, skulls, flowers, bolt heads, butterflies, hearts, smiley faces, and snowflakes etc.

It will be appreciated that all Talon types can be designed to integrate with rail systems and locking assemblies.

Talon Rails consist of a slotted rail and either a Talon Bracket or a Bracket Body that fits within the rail. For purposes of the forgoing discussion, Talon Brackets and Bracket Bodies, are referred to collectively as Bracket Bodies.

These assemblies are similar to the rail assemblies discussed above in that the Bracket Body and Rail share interlocking patterns of slots and protrusions to hold the Bracket Body in lateral positions on the Rail. It will be appreciated that the exact location, configuration, and shape of these slots (or indentations) and protrusions are almost limitless due in part to the complementary interlocking nature of the two components surfaces, and the fact that a spring mechanism maintains the locked position between the two components.

Preferred embodiments of this system uses a spring (or springs) to press and hold the Bracket Body (or a component of the Bracket Body) and Rail into "locked" positions with one another.

In an embodiment of the Basic Talon Rail Assembly Bracket Bodies are released from their locked position by simply pressing the Bracket Body back toward the mounting surface. Initially the Bracket Body will meet resistance from a compression spring, but will move backwards. This backward movement will eventually liberate the Bracket Body from its interlocking connection with the rail. Once free, continue applying rearward pressure and slide the Bracket Body to the desired position. Next, remove all pressure from the Bracket Body. Springs (or a single spring) located between the Glide Plate and the Bracket Body will force the Bracket Body forward, relocking the Bracket Body's edges with those of the Rail.

By reversing the location of the notches on the Rail, Bracket Body, Glide Plate, and spring, a design is provided that requires a user to pull the Bracket Bodies outward to move them laterally.

Other embodiments are made to move medially without applying any pressure, by slanting the contact faces of the interlocking portions of the components.

Another embodiment of the invention includes a Pull Pin Assembly. In order to move a Bracket Body laterally, a user must pull a pin outward, which is being forced inward by a spring. Hold the pin in the outward position. Move the Bracket Body to the desired position. Release the pin.

In one embodiment a medial side of the interior tip of the Release pin is cut at an angle. This cut allows for the entire Bracket Body to be moved medially only without pulling the Release Pin.

In other preferred embodiments of the instant invention, the gripping members are both located a fixed distance apart from one another. In such embodiments, the gripping members are shaped and positioned in such a manner that the gap between the pair of gripping members generally forms the profile of the equipment being held (such as the profile of the tip of a ski or snowboard). In one embodiment in which the gripping members form a profile for holding the generally curved tip of a snowboard or ski, the mounting body of the invention is a single generally box-shaped solid member (Primary Component) with a curved profile or groove cut horizontally into the solid member, but not all the way through. The profile approximates the profile of a snowboard's or snow ski's tip, with the opposing surfaces of the groove being the pair of gripping members. The ski or snowboard is placed within the groove by sliding the tip into the open end of the groove. In a preferred embodiment, a repositionable flap is used to cover the open end of the groove and hold the ski, snowboard or other equipment within the groove. In the some, the flap has a threaded pivot protrusion, which is inserted into the side of the Primary component. When at rest the flap is spring loaded to stay in the open position. In other embodiments, the flap can be locked into the closed position, prohibiting the snowboard from being removed.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. An equipment rack comprising:

a pair of gripping members, said pair of gripping members being adjustable together and apart from one another; and a support for mounting said pair of gripping members to a fixed object;

wherein said support comprises:

a rail along which said pair of gripping members are adjustably positioned;

a mount attaching said rail to the fixed object;

wherein said mount comprises a mounting plate that is connected to said rail via a rotatable connection;

wherein said rotatable connection comprises an inner rotator fixedly connected to said mount plate and an outer rotator fixedly connected to said rail; and a ski component, said ski component including a generally cylindrical sleeve that at least partially surrounds said outer rotator, and a gripping member portion associated with said sleeve, said gripping member portion being positioned along said rail between said pair of gripping members.

2. The equipment rack as claimed in claim 1 wherein said gripping members are adjustable together and apart from one another via an adjustable rod assembly.

3. The equipment rack as claimed in claim 1 wherein said gripping members are adjustable together and apart from one another via an adjustable rod assembly.

4. The equipment rack as claimed in claim 3 wherein said adjustable rod assembly comprises a reverse-threaded rod with left hand threads on one end and right hand threads on an opposing end of the rod.

5. The equipment rack as claimed in claim 4 further comprising a knob attached to one end of said rod.

6. The equipment rack as claimed in claim 5 wherein said knob includes an off-center bore for location of a locking member.

7. The equipment rack as claimed in claim 6 wherein said support comprises a rail along which said pair of gripping members are adjustably positioned, and wherein said knob is located adjacent to an end of said rail such that a gap between said knob and said end of said rail is narrower than said locking member to limit rotation of said rod.

8. The equipment rack as claimed in claim 6 wherein said locking member includes a locking bar that extends across said support.

9. The equipment rack as claimed in claim 3 wherein said gripping members compress about opposing edges along the width of a side of a item of sports equipment being held within said gripping members.

10. The equipment rack as claimed in claim 1 wherein said gripping members include a tapered shape.

11. The equipment rack as claimed in 10 wherein said tapered shape creates a generally greater distance between said pair of gripping members toward a posterior of said gripping members and a smaller distance toward an anterior of said gripping members.

12. The equipment rack as claimed in claim 1 wherein gripping members include a spacer member that creates a protective barrier between said support and a piece of equipment being held between said gripping members.

13. The equipment rack as claimed in claim 12 wherein said spacer member is integral with the gripping member.

14. The equipment rack as claimed in claim 1 wherein said gripping member includes slot through which said support extends.

15. The equipment rack as claimed in claim 1 further comprising a locking member for preventing removal of equipment held between said gripping members.

16. The equipment rack as claimed in claim 15 wherein said locking member limits adjustment of said gripping members together and apart from one another.

17. The equipment rack as claimed in claim 15 wherein said locking member extends across said support and the equipment being held.

18. An equipment rack comprising:

a pair of gripping members, said pair of gripping members being adjustable together and apart from one another;

a support for mounting said pair of gripping members to a fixed object;

wherein said support comprises:

a rail along which said pair of gripping members are adjustably positioned; and a mount attaching said rail to the fixed object;

wherein said mount comprises a mounting plate that is connected to said rail via a rotatable connection that allows said rail to rotate about a z-axis of said rail;

wherein said rotatable connection comprises an inner rotator fixedly connected to said mount plate and an outer rotator fixedly connected to said rail; and a ski component, said ski component including a generally cylindrical sleeve that at least partially surrounds said outer rotator, and a gripping member portion associated with said sleeve, said gripping member portion being positioned along said rail between said pair of gripping members.

19. The equipment rack as claimed in claim 18 wherein said gripping members are adjustable together and apart from one another via an adjustable rod assembly.

20. The equipment rack as claimed in claim 1 wherein said rotatable connection includes a removable pin to selectively prevent rotation of said rotatable connection.

21. An equipment rack comprising:

a pair of gripping members, said pair of gripping members being adjustable together and apart from one another;

a support for mounting said pair of gripping members to a fixed object;

wherein said support comprises:

a rail along which said pair of gripping members are adjustably positioned; and a mount attaching said rail to the fixed object;

wherein said mount comprises a mounting plate that is connected to said rail via a rotatable connection that allows said rail to rotate about a z-axis of said rail;

wherein said gripping members are adjustable together and apart from one another via an adjustable rod assembly;

wherein said adjustable rod assembly comprises a reverse-threaded rod with left hand threads on one end and right hand threads on an opposing end of the rod;

a knob attached to one end of said rod;

wherein said knob includes an off-center bore for location of a locking member; and wherein said locking member includes a locking bar that extends across said support.

* * * * *